US011089829B2

(12) United States Patent
Sim

(10) Patent No.: US 11,089,829 B2
(45) Date of Patent: Aug. 17, 2021

(54) OPEN-TOP HAIR CAP WITH FASTENERS FOR HAIR EXTENSION

(71) Applicant: Jaesung Sim, Orlando, FL (US)

(72) Inventor: Jaesung Sim, Orlando, FL (US)

( * ) Notice: Subject to any disclaimer, the term of this patent is extended or adjusted under 35 U.S.C. 154(b) by 267 days.

(21) Appl. No.: 16/287,360

(22) Filed: Feb. 27, 2019

(65) Prior Publication Data

US 2020/0268084 A1 Aug. 27, 2020

(51) Int. Cl.
*A41G 5/00* (2006.01)

(52) U.S. Cl.
CPC ..... *A41G 5/0053* (2013.01); *A41G 5/0046* (2013.01); *A41G 5/0093* (2013.01)

(58) Field of Classification Search
CPC .. A41G 5/0053; A41G 5/0093; A41G 5/0046; A41G 5/0073; A41G 5/0033; A41G 5/0006; A41G 5/0013; A41G 5/0026; A41G 5/004; A41G 5/00; A41G 3/0016; A41G 3/0033; A41G 3/0041; A41G 3/005; A41G 3/0058; A41G 3/00; A41G 5/008; A41G 3/0008; A45D 8/36; A45D 8/40; A45D 8/004; A45D 8/006; A45D 8/002; A45D 44/22; A44C 15/006; A42B 1/002; A42B 1/019; A42B 1/02; A42B 1/041; A42B 1/049; A42B 1/208; A42C 5/02; A42C 5/04
USPC ..... 132/53, 54, 201, 274, 275; 2/174, 181, 2/206, 207
See application file for complete search history.

(56) References Cited

U.S. PATENT DOCUMENTS 415,104 A * 11/1889 Godefroy ..... A45D 8/38 132/54
3,782,396 A * 1/1974 Tomlinson ..... A42B 1/004 132/53
2017/0215506 A1* 8/2017 Sim ..... A41G 3/0066
2018/0332917 A1* 11/2018 Wonsey ..... A42B 1/041

FOREIGN PATENT DOCUMENTS

GB 1555971 A * 11/1979 ..... A42B 3/00

* cited by examiner

*Primary Examiner* — Jacqueline T Johanas
*Assistant Examiner* — Daniel Philip Bissette
(74) *Attorney, Agent, or Firm* — Young Jeon

(57) ABSTRACT

A head covering with a band portion in a shape of a flat strip or loop and a plurality of flat members that are connected to or a part of the band is disclosed. The flat members projects toward a top side of the band. An outer surface of the flat members includes or is made of a material that can be fastened to a certain corresponding type of material. Thereby, the invention provides a foundation for hairpieces having a fastening component that corresponds to a fastening component used in the invention. The flat members as a whole generally cover a scalp of a head but not completely, exposing the scalp through gaps between flat members. Especially, a top portion or a crown of a scalp is generally exposed due to an open-top construction of the head covering. However, as a single hairpiece is fastened to multiple flat members, the hairpiece in turn works to hold the multiple flat members together. When more hairpieces are attached to flat members, the flat members become structurally solid in a shape that conforms to the contour of the scalp. In so doing, hairpieces cover and bridge the gaps between flat members, thereby completely covering a head.

1 Claim, 3 Drawing Sheets

OPEN-TOP HAIR CAP WITH FASTENERS FOR HAIR EXTENSION

FIELD OF THE INVENTION

The application relates to hair devices, more specifically foundation frames for hair structures. A head covering according to the various embodiments disclosed herein provides an easier way to install hairpieces, such as hair wefts, onto the head covering. The disclosure includes a unique construction of a head covering which enables various kinds of fastening mechanisms to be utilized for hairpieces including a press-and-lock fastening mechanism where two separate pieces are fastened together by simply pressing one onto another and thereafter unfastened by simply pulling them apart. A press-and-lock type fastening enables repeat reattachment, allowing hairpieces to be installed easily on a head covering and later reused on another head covering.

BACKGROUND

Many people, including a large number of women of African descents, wear wigs to satisfy their desire to go beyond the limit of their natural hair. Unlike other hair styling solutions such as dyeing that changes the color of hair or perming that changes the type of hair, wigs are worn to change not only color and type of hair but also length, texture, density of hair, and so on. Wigs provide virtually limitless style options to anyone including people with little to no natural hair on their head. For centuries, wigs had been an item fulfilling various needs of people including men and women.

Nonetheless, wigs fall short of a perfect styling option despite its long history and increased affordability. For one, wigs are fairly expensive due to the cost of raw materials and the craftsmanship involved. Another shortcoming of wigs is that once you purchase a wig, your style choices become limited. At the most, you can modify its style to some extent by trimming or cutting the length of hair and applying heat or chemicals. However, the wig's hair does not grow back like natural hair, so any modification is more or less irreversible. Considering the finite nature of design and style choices available to a certain wig, wigs certainly lack versatility.

For forgoing reasons, increasing number of people are opting for creating their own wigs by sewing and gluing hairpieces on head caps worn over their heads. You can choose from a vast variety of hairpieces, typically hair wefts, which are hair strands tied together on one end of each strand of hair by fabric threads called wefts. To complete a hairdo, you can compile a set or combination of hairpieces to create a unique look. Then, you can simply wear a cap over your head on which hair wefts can be sewed or glued. The cap can be taken off and put on as desired just like a wig. However, the forgoing procedures are usually performed professionally by beauticians at salons as they are time-consuming and require advanced techniques. As the hair cap is worn over a human body, the hair cap deteriorate in shape or contaminated overtime and must be discarded at some point. When a new hair-do is desired or the hair cap becomes undesirable due to deterioration or contamination, the hairpieces must be removed through another labor-intense process involving cutting stitches or carefully treating the glued area to dissolve chemicals and carefully pulling away the hairpieces. Even with utmost care, the detached hairpieces are mostly unusable because of the remnant of stitches and glue or deterioration involved in the detachment procedure.

There were attempts to redress these shortfalls of sewing or gluing of hairpieces, which is labor-intense, time-consuming, and often messy. One of the attempt is disclosed in the U.S. patent application Ser. No. 09/851,834 filed on May 9, 2001 by Whitfield (hereinafter Whitfield), deploying Velcro™ tracks to allow hair wefts to cling onto a hair cap using Velcro™ strips. This idea of utilizing Velcro™ strips for attaching hair extensions have been applied to interchangeable wigs disclosed in U.S. patent application Ser. No. 13/955,596 filed on Jul. 31, 2013 by Queen and Lee (hereinafter Queen) where partial wigs had a hook-like strips to be utilized for securing them on to head. A more recent U.S. patent application Ser. No. 14/937,690 filed on Nov. 10, 2015 by Ezechukwu (hereinafter Ezechukwu) discloses a hair extension device that employs strips as a fastening means wherein strips are equipped with hook-like and loop-like surfaces. Applicant himself made an improvement on the prior arts by applying Velcro™ elements on a hair cap in U.S. patent application Ser. No. 15/008,648.

These inventions, while suggesting a more convenient and easy way to extend hairs using Velcro™ type fastening mechanism, fell short of providing a practical alternative to a conventional hair extension techniques, which have been dominant hair styling methods for years, because conventional hair cap could not appropriately support Velcro™ type fastening mechanisms. In fact, the Velcro™ or other similar fastening mechanisms will reduce the flexibility of a head covering that is worn over a head, an ovoid-shaped structure, resulting in an unseemly and uncomfortable fit. Also, the Velcro™ type systems have two different elements, one of which is a loop-like surface that is more flexible than the other, a hook-like surface. In turn, prior arts often rely on the flexibility afforded by a loop-like surface to cover or lay tracks on a head covering. Consequently, hair that is prone to stick to loop-like surfaces easily gets tangled so as to decrease the utility and functionality of the head covering, if not making them completely useless over a time period. The result is a messy and unpleasant look, which goes against the whole purpose of wearing wigs. On top of that, there is the discomfort to the wearer caused by having a rigid structure put on a scalp. Thus, there exists a need for a practical and aesthetically pleasing alternative to provide a foundation for press-and-lock systems or similar fastening methods over a head.

BRIEF SUMMARY

The present invention is a head covering with an open top construction. The head covering is mainly composed of a band portion and a top portion. The band portion can be either a strip or a loop that can be worn around a head like a typical head band. The top portion of the head covering is composed of a plurality of flat members that further extends from the band portion, and these flat members project toward an upper side of the band. Thus, when the head covering is worn around a head, the flat members can lie on a scalp not necessarily touching the scalp. The flat member's surface that faces outward, which is the opposite direction of the side facing the scalp, works, incorporates, or provides a fastening mechanism that can offer an easy attachment and detachment for hairpieces that incorporates the same or corresponding fastening mechanism. A preferred fastening mechanism is a press-and-lock fastening mechanism where two separate pieces are fastened together by simply pressing one onto another and thereafter unfastened by simply pulling them apart. A press-and-lock type fastening enables repeat reattachment, allowing hairpieces to be installed easily on a head covering and later reused on another head covering. When the head covering is worn over a head, the flat members generally cover a scalp, but they are not fixed on the head or in relation to each other. However, when a hairpiece is fastened onto more than one flat member, the flat members are fastened by a single hairpiece and thus fastened to each other. When such fastening occurs from a flat member to another and so on, the flat members are fixed in a shape that conforms to the shape of the scalp by the network of flat members and hairpieces.

Generally, hairpieces that are used to be sewn or glued for hair extension come in a form of hair wefts. And the hair wefts come in various weft lengths, meaning the thin strip of threads that bind hair strands in a hair weft can have any length. In fact, wefts are usually cut into a desired length for any given hair work including weaving, hair extensions, and making of wigs, among others. Then, the pieces are consecutively applied around a head in a horizontal fashion around a scalp, making rows of hair wefts in a general direction of bottom to top. Hence, as wefts are applied to flat members and eventually to cover an entire scalp, flat members are organized and linked by wefts to create a structure that conforms to the contour of a head. Because flat members can leave gaps between them as wide as a single hair weft can cover, they do not need to stretch or be tailored to conform to the head contour. As such, they can be made of a non-stretch material that can withstand the physical stress required and caused by fastening and unfastening hairpieces while the head covering comfortably sits on and easily adjusts to various sizes and shapes of heads.

An object of this invention is to provide a firm and solid platform for various fastening means especially that requires substantial physical strength during fastening and unfastening while ensuring that the platform comfortably but closely and firmly sits on a human head that is of a non-standard ovoid shape. One of fastening mechanisms that can be used for hair extension work is Velcro™, which utilizes two surfaces, one with hook-like elements and the other with loop-like elements, that can repeatedly bind together and pulled apart deliberately. However, if any of the surfaces is stretchable or weak, then instead of being pulled apart, the stretchable surface can be simply stretched out to the point it cannot recover its original form or can be torn. This leaves many fastening mechanisms including many press-and-lock fastening mechanisms such as Velcro™ unfit for a traditional head covering that offers a comfortable and tight fit. The present invention solves the problem by providing an open-top construction head covering with plurality of small members that form a top structure fitting a contour of a head in combination with hairpieces.

Another object of this invention is to provide a comfortable and tight-fitting hair cap. The aforementioned small members can be shaped and formed in a way that promotes a better and tighter fitting over a head.

DETAILED DESCRIPTION

Figure 1:
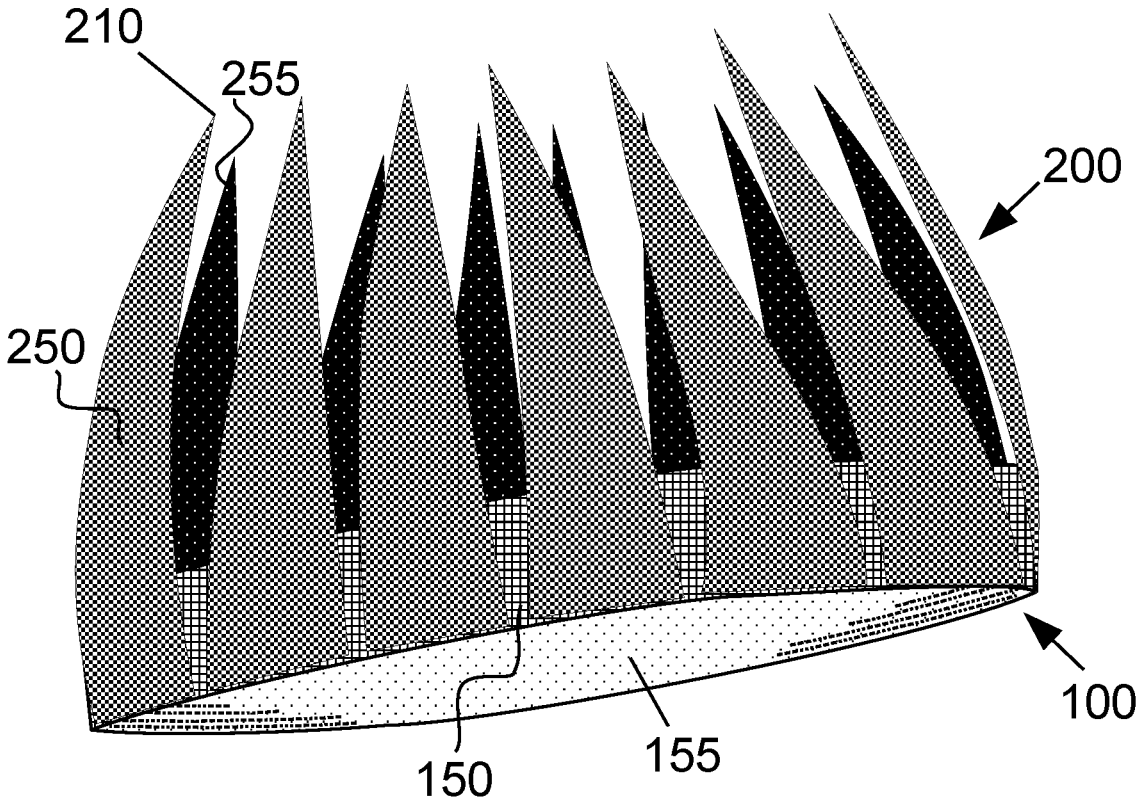
FIG. 1 is a perspective view of a head covering with isosceles-shaped flat members.
Figure 2:
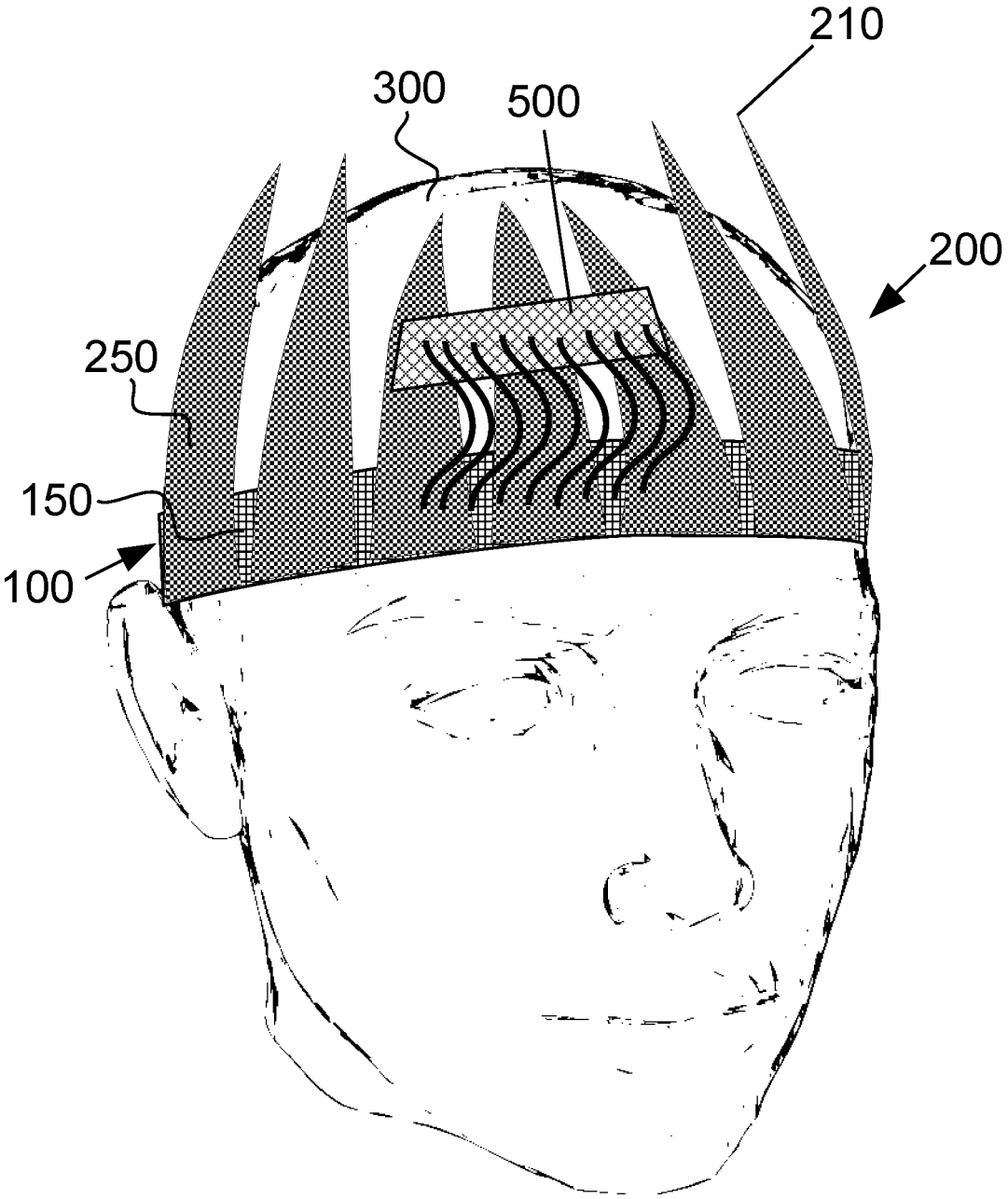
FIG. 2 is a perspective view of the head covering shown in FIG. 1, worn over a small head. A hairpiece is fastened onto the head covering.

The invention relates to a head covering comprising a band portion 100 in a shape of a flat strip or loop and a top portion comprised of a plurality of flat members 200 that are affixed to or connected to the band portion 100. The flat members 200 projects toward a top side of the band portion 100 so that when the head covering is worn over a head, the flat members can generally lie on or over a scalp. An outer surface 250 of the flat members 200 includes or is made of a material, element, or composition that can be fastened to a certain corresponding type of material, element, or composition. The invention provides a foundation for hairpieces 500 having counterparts of the fastening component of the head covering. For example, a hairpiece 500 can be manufactured by attaching hair strands on a patch containing loop-like elements of Velcro™, and outer surfaces 250 of flat members 200 can contain hook-like elements of Velcro™. As a single hairpiece 500 is fastened to multiple flat members 200, the hairpiece 500 in turn works to hold the multiple flat members 200 together. When more hairpieces 500 are fastened to flat members 200 covering a substantial part of a scalp 300, the flat members 200 are tied in a shape that conforms to the contour of the scalp 300.

In an embodiment, a band portion 100 is made of a thin stretchable fabric with circumference of about 16 inches, when not stretched, and width of approximately an inch. A multiplicity of separate flat members 200 are attached to an outer surface 150 of the band portion 100. Each flat member 200 is in an isosceles-shape with approximate width of an inch and height of about eight inches. The flat members 200 are so aligned with the band portion 100 that a short side of an isosceles flat member is in parallel with a rim of the band portion; an inch length of each flat member 200 overlaps with the band portion 100; and top ends 210 of the flat members 200 are on a same side of the band portion 100. The total number of flat members 200 are eighteen in this embodiment, and the flat members 200 are cut out from a hook sheet, which is a thin and flexible plastic sheet with a surface having hooks. Each flat member 200 is less than an eighth of an inch apart from adjacent flat members and is sewn onto the outer surface 150 of the band portion 100 with the surface with hooks facing outward.

The circumference of a band portion 100 may be smaller or bigger than 16 inches; and the width of a band portion 100 smaller or bigger than an inch. Not only for a better fit and comfort but also depending on materials used, desired hairdos, and environment to be exposed, the choices can vary widely. A band portion 100 can also have additional features. For example, an inner surface 155 can be lined with a soft silicon track that goes around the circumference to prevent the band portion 100 from slipping on a head.

Also, the outer surface 150 of a band portion 100 may provide additional surface for a fastening mechanism. For example, in a unitary construction of flat members 200 and a band portion 100, deploying fastening mechanism on the outer surface 150 can effectively provide more surface for hairpieces to be fastened. On the other hand, separate flat members 200 may be fastened to a band portion 100 using the outer surface 150 of the band portion 100 with fastening elements if an inner surface 255 of flat members 200 has counterpart fastening elements.

While a stretchable fabric is preferable, the band portion 100 can be made of virtually any material. In fact, a band portion 100 may be formed with a desired length of strip and simply joining the ends of the strip together. An additional fastening surface or fastening mechanism may be provided for a strip to freely adjust to a desired circumference. As such, physical characteristics and configuration of a band portion 100 can be easily tailored to a specific styling need as well as other factors important in garments, such as heat dissipation, moisture control, softness, and durability.

Flat members 200 can have varying sizes, shapes, and numbers. For example, their shape need not be identical. In other words, some of the flat members 200 of a head covering can have triangular shapes while others have rectangular shapes. In general, an aggregated width of top ends 210 of the flat members 200 should be narrower than the circumference of a band portion 100 in order to accommodate an ovoid shape of a head. But this by no means restricts the configuration of a head covering because flat members 200 can overlap each other anywhere including at top ends 210. Also, a scalp 300 needs not be covered entirely or even substantially because hairpieces to be installed are usually big enough to bridge substantial gaps between flat members 200. This creates a great freedom of design and combination of flat members 200. Generally speaking, a smaller flat member is desired in a scalp area with a smaller radius of curvature, and vice versa. Very few and small flat members 200 can be still fully functional because structural integrity is generated from hairpieces 500 binding with more than one flat member 200. Hence, flat members 200 can have varying configuration of sizes, shapes, and numbers to facilitate easier and quicker installation of hairpieces 500 while simultaneously ensuring a tight and comfort fit.

Flat members 200 may have additional characteristics to allow body heat and moisture to dissipate. A pattern of perforation or surface groove can be an example of features to improve thermal conductivity and moisture permeability, and other physical or chemical compositions or layers to control body odor and bacterial growth may be added. For example, an inner surface 255 of flat members 200 may have an additional layer of fabric or surface treatments that provide better feel on human skin. Typically, an inner surface 255 of flat members 200 is desired to stick to skin or hair to prevent a head covering from slip or fall off. This characteristic can be provided by adding an extra layer to the flat members 200 or incorporating a material or fabric into a single layer of flat member 200. In manufacturing, however, incorporating a fastening mechanism and extra features into a single layer of flat member 200 may raise cost and not feasible, and thereby multiple layers may be preferred. For example, a flat member 200 may be made of a meshed fabric on which a nylon fabric with fastening elements is added on an outer surface 250.

Although there is little limitation to what material can be used for flat members, too much flexibility of flat members 200 can cause hardship as to wearing a head covering over a head and affixing hairpieces 500 thereto. In that case and also in general, a supplemental structure may be added to and between flat members 200 in anywhere between top ends 210 and a band portion 100. The supplemental structure may have narrower width and smaller circumference than the band portion 100 to conform to an ovoid shape of heads. However, just a single thread, for example, can temporarily hold the flat members 200 together until hairpieces 500 are fastened. Hence, a supplemental structure can be of small circumference than desired, in which case the structure can be simply removed or stretched; of larger circumference than desired, in which case the structure can be simply not used for structural support after hairpieces 500 are installed; and of any material because it only needs to temporarily hold flat members 200 together. In addition, a multiplicity of supplemental structures can be present if desired.

A flat member 200 can be attached to a band portion 100 in various ways. An overlapping of flat member 200 over a band portion 100 enables an outer surface 250 with a fastening mechanism to cover a band portion 100 even if the band portion 100 lacks a fastening mechanism on the outer surface 150. The overlap can also occur on the other side of a band portion 100 by attaching an outer surface 250 of a flat member 200 onto an inner surface 155 of a band portion 100. When an overlap is not desired, it can be entirely avoided by simply sewing or affixing a flat member 100 to a rim of a band portion 100. This makes of a thinner head covering and can be preferred when either or both of the materials used for flat members 200 and a band portion 100 are of substantial thickness. Also, flat members 200 and a band portion 100 can be of unitary construction that is made from, for example, a wide and flat fabric or sheet that is cut to form a flatten out version of the invention comprising both a band portion and a top portion. Although thickness of flat members 200 and a band portion 100 is of importance in general, where the thinner is the better, there are a wide variety of available materials that could be as thin as less than a millimeter thick.

Figure 3:
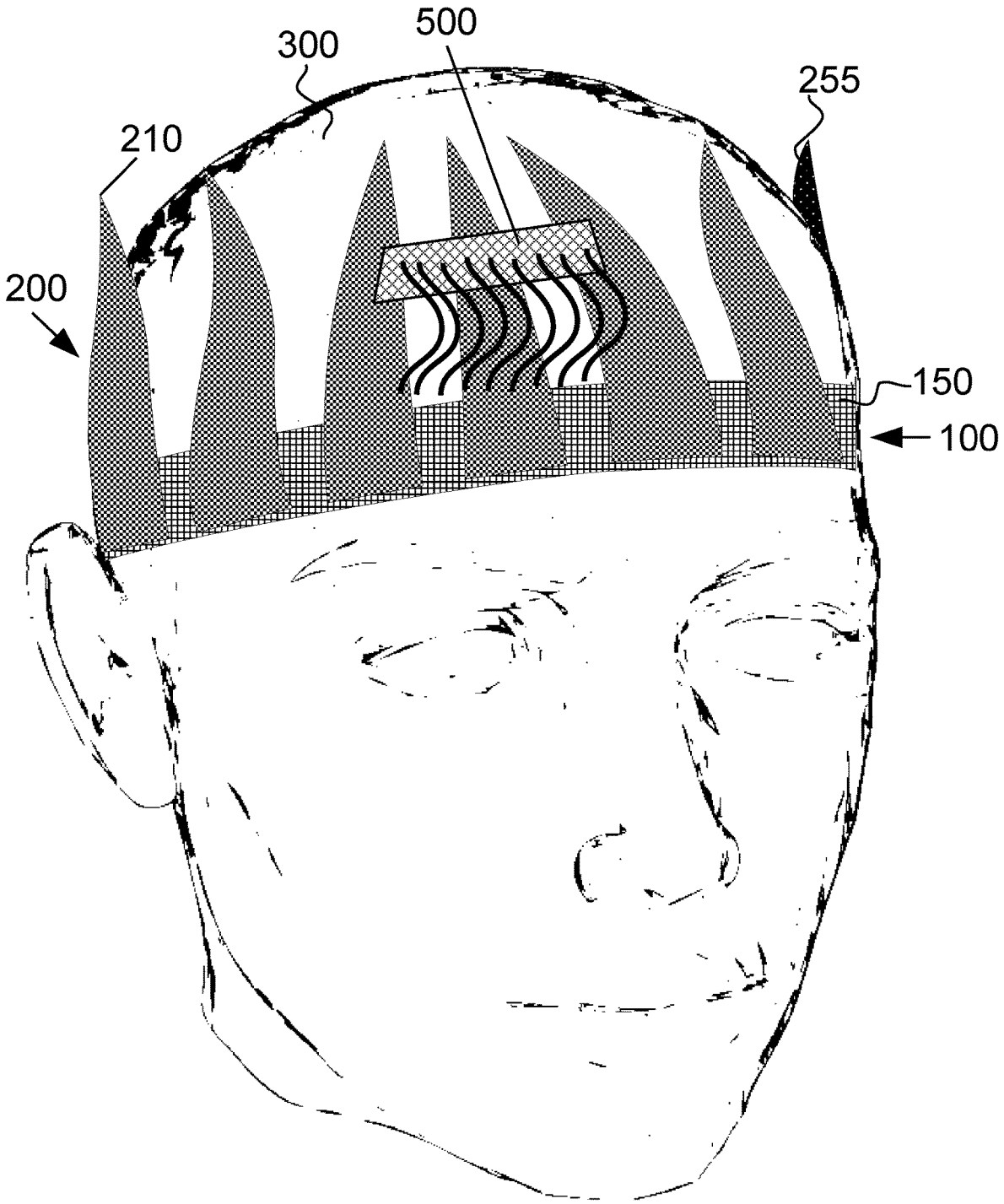
FIG. 3 is a perspective view of a head covering shown in FIG. 1, worn over a large head. The hairpiece shown in FIG. 2 is fastened onto the head covering.

When there is an overlap of a flat member 200 and a band portion 100, it is preferable to have only part of the overlapping area be utilized to affix two structures. For example, if an entire overlapping area of a flat member 200 is sewn on a band portion 100 and the aggregated overlapping area takes up a substantial part of the band portion 100, then the band portion 100 may be restrained from stretching. To explain, in most cases, the affixed area would stretch only as much as a less stretchy material of the two materials affixed together. Here, usually the material used in flat members 200 would restrain a band portion from stretching freely. If a substantial portion of band portion 100 is affixed to flat members 200, the band portion 100 would not stretch enough to ensure a comfort fit. In fact, as shown in FIG. 3. a bigger head requires a band portion 100 to stretch much further than a smaller head. Generally, a third of the width of a flat member 200 is sufficient to securely attach it to a band portion 100 without restricting the flexibility of a band portion 100.

The outer surfaces 250 of flat members can be of a plastic sheet or nylon fabric that provides substantial physical strength for Velcro™ fastening mechanism to function as intended. However, the material composition of a flat member 200 is never limited to a certain material, nor does an outer surface 250 need to have Velcro™ type fastening elements. There are many alternatives to Velcro™ despite its great capability to attach and detach so quickly, securely, and easily. Various companies developed their own version of press-and-lock type mechanisms including Dual Lock™ of 3M™, and there are other possibilities, such as snap fasteners, that could be used as a fastening mechanism for the invention. Of course, many common fastening mechanisms utilized in garments or other fields can be easily adopted to the invention.

As discussed earlier, flat members 200 by themselves do not need to provide a structural integrity that is required to hold them together tightly over a scalp 300. The structure of a head covering is complete when hairpieces 500 are fastened to flat members 200. The resulting structure will fit the contour of a scalp 300. However, sometimes it helps that top ends 210 of flat members 200 stay loosely bound together until all hairpieces 500 are installed. Therefore, top ends 210 or in fact any part of flat members 200 may be tied or linked together by threading, applying a removable tape, applying an elastic band, and so on. This additional binding is especially useful when a head covering is worn over a large head as shown in FIG. 3 because the flat members 200 are relatively too short to lie on or over a scalp 300. Typically, this does not render the head covering unfit because most people utilize a specially designed hairpiece that cover the top portion of a head. This top hairpiece is usually of a substantial size and can connect top ends 210 of flat members 200. Nonetheless, if top ends 210 are initially loosely bound together at the top, for example, with an elastic band, it is easier to install hairpieces including top hairpiece.

A person of ordinary skill in the art and relevant fields including beauty suppliers, wig makers, hair beauticians, hair designers, weaving and braiding specialists, among others, would realize that the invention is not limited to any specific configuration of a band portion 100 and a top portion comprised of flat members 200 because those configuration can be modified and should be modified per various factors including a specific need of a hairdo, the existence of natural hair, the type and length of natural hair, the type and length of hairpieces to be used. Hence, the configurations shown, described, or specified herein shall not be construed to limit the scope of the invention.

The invention claimed is:

1. A hair extension method, comprising:

covering a head with a head covering, comprising a band portion that is made of a thin, elastic fabric in a shape of a flat strip or loop, a top portion comprising a plurality of flat members that are in triangular shape that narrows at each flat member's top end and projecting toward a side of the band portion, wherein the plurality of flat members are affixed onto the band without otherwise being fixed in relation to each other, and a Velcro™ hook sheet that is attached to, is incorporated in, or constitutes an outer surface of the flat members for attaching hairpieces onto the head covering; and attaching one or more hairpieces, each comprising one or more hair strands and a Velcro™ loop sheet that is attached to, is incorporated in, or constitutes a part of the one or more hair strands to a plurality of the flat members of the head covering that are lied on a scalp area.

* * * * *